US007309121B2

(12) United States Patent
Hatasa et al.

(10) Patent No.: US 7,309,121 B2
(45) Date of Patent: Dec. 18, 2007

(54) LIQUID SUPPLYING SYSTEM AND APPARATUS INCORPORATING THE SAME

(75) Inventors: Nobuyuki Hatasa, Kanagawa (JP); Hiroyuki Ishinaga, Tokyo (JP); Ryoji Inoue, Kanagawa (JP); Hideki Ogura, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 399 days.

(21) Appl. No.: 10/950,912

(22) Filed: Sep. 27, 2004

(65) Prior Publication Data

US 2005/0068386 A1 Mar. 31, 2005

(30) Foreign Application Priority Data

Sep. 29, 2003 (JP) ..... 2003-338722

(51) Int. Cl.
*B41J 2/175* (2006.01)

(52) U.S. Cl. ..... 347/85

(58) Field of Classification Search ..... 347/7, 347/85–87
See application file for complete search history.

(56) References Cited

U.S. PATENT DOCUMENTS

| | | | | |
|---|---|---|---|---|
| 5,610,635 | A * | 3/1997 | Murray et al. | 347/7 |
| 5,699,091 | A | 12/1997 | Bullock et al. | |
| 6,022,102 | A * | 2/2000 | Ikkatai et al. | 347/85 |
| 6,270,211 | B1 | 8/2001 | Long | |
| 6,520,630 | B1 | 2/2003 | Oda | |
| 2003/0071874 | A1 | 4/2003 | Kobayashi | |

FOREIGN PATENT DOCUMENTS

| | | |
|---|---|---|
| EP | 1219448 A | 7/2002 |
| JP | 2001-162820 | 6/2001 |

* cited by examiner

*Primary Examiner*—An H. Do
(74) *Attorney, Agent, or Firm*—Canon U.S.A. Inc. I.P. Div

(57) ABSTRACT

An ink supplying system for supplying ink to a recording head of a recording apparatus. The ink supplying system includes an ink tank for containing the ink and an ink supplying unit, connected to the ink tank via communication paths, for supplying the ink from the ink tank to the recording head. The ink in the ink tank is introduced into the ink supplying unit through at least one of the communication paths, and gas in the ink supplying unit is transported into the ink tank through at least a different one of the communication paths. At least one of the ink tank and the ink supplying unit has storage means for storing information regarding the amount of ink in the ink supplying system.

10 Claims, 11 Drawing Sheets

LIQUID SUPPLYING SYSTEM AND APPARATUS INCORPORATING THE SAME

CROSS REFERENCE TO RELATED APPLICATIONS

This application claims priority from Japanese Patent Application No. 2003-338722 filed Sep. 29, 2003, which is hereby incorporated by reference herein.

BACKGROUND OF THE INVENTION

1. Field of the Invention

The present invention relates to a recording apparatus, and more particularly to an ink supplying system.

2. Description of the Related Art

Since an inkjet recording apparatus for forming an image on a recording medium by applying liquid ink to the recording medium by, for example, an inkjet recording head serving as a device which uses a liquid can form small dots close together with a relatively low noise level during recording, the inkjet recording apparatus is nowadays used in many types of recording operations, such as color image recording operations. One type of such an inkjet recording apparatus comprises an inkjet recording head, a carriage, and transporting means. The inkjet recording head receives ink from an integrally and inseparably or separably mounted ink tank. The carriage allows the recording head to perform a main scanning operation in a predetermined direction with respect to a recording medium by carrying the recording head. The transporting means transports the recording medium in a direction perpendicular to the main scanning direction so as to carry out a sub-scanning operation. The inkjet recording apparatus performs a recording operation on the recording medium by discharging ink during main scanning by the recording head. When a recording head, which can discharge black ink and color ink (such as yellow, cyan, and magenta ink), is mounted on the carriage, not only can monochromatic recording of a text image using black ink be carried out, but also full-color recording of an image can be carried out by changing the proportion of discharge of each ink.

A very small ink path is formed in the inkjet recording head. Any ink to be supplied to the recording head from the ink tank is required to be clean without any foreign matter, such as dust. If the ink contains any foreign matter, the foreign matter gets stuck in the ink path in the recording head, particularly, in a narrow discharge opening and a liquid path portion that directly communicates with the discharge opening. Therefore, it may be impossible to restore functions of the recording head.

To overcome this problem, in general, a structure for preventing entry of foreign matter into the recording head by a filter for removing any foreign matter is often used in the ink path between the recording head and an ink supply needle inserted in the ink tank.

Nowadays, in order to increase recording speed, the number of discharge openings of the inkjet recording head for discharging ink is increased, or drive signals of higher frequency are applied to a device for generating energy for discharging ink. Therefore, the amount of ink consumed per unit time is sharply increased, thereby obviously increasing the amount of ink passing through the filter. An effective way of reducing pressure loss by the filter is to form the filter with a large area by enlarging part of an ink supply path. However, when gas bubbles enter the ink supply path, the gas bubbles tend to be retained in a space at an upstream side of the filter at the enlarged portion of the ink supply path. Therefore, when these gas bubbles cannot be discharged, ink may not be smoothly supplied. In addition, gas in the ink supply path becomes minute gas bubbles that can mix with the ink that is guided to the discharge openings of the recording head. This may, for example, prevent ink discharge from the recording head. To overcome this problem, in such an inkjet recording apparatus, it is important not to allow gas, such as air, to be introduced into the ink supply path. The main reason for gas to flow into an ink supply system is, for example, depletion of ink in the ink tank and replacement of the ink tank.

Related replaceable ink tanks are ink tanks having a storage medium for holding information on the amount of ink in the ink tank, as disclosed in U.S. Pat. No. 5,699,091, an ink tank that is not capable of detecting ink, and an ink tank capable of detecting depletion of ink in the ink tank as disclosed in Japanese Patent Laid-Open No. 2001-162820.

As disclosed in U.S. Pat. No. 5,699,091, in order to minimize the introduction of gas, such as air, into the ink supply path of the inkjet recording apparatus, ordinarily, a user is prompted to replace the ink tank by stopping the recording apparatus having a predetermined amount of ink left in the ink tank after being informed of the residual ink amount in the ink tank based on the ink amount information held by the storage medium. As disclosed in Japanese Patent Laid-Open No. 2001-162820, ordinarily, the ink tank detects depletion of ink by, for example, optically detecting the residual ink amount by using a prism and an optical sensor or by detecting the residual ink amount by making use of a change in the electrification resistance between two electrode pins. Both of these methods are used to detect whether or not the residual ink amount has reached a predetermined amount. Since there may be an error in detecting the residual ink amount caused by the introduction of gas, such as air, into the ink supply path of the inkjet recording apparatus, the user is informed of the running out of ink with a predetermined amount of ink remaining in the ink tank.

Therefore, the ink tank disclosed in this patent document is discarded before the ink in the ink tank is used up.

The user determines the residual ink amount in the ink tank that is not capable of detecting ink on his own. Therefore, when the ink in the recording head in addition to that in the ink tank and the ink supply path is used up, and a recording image starts to get blurred, the user determines that the ink tank has run out of ink, and, thus, replaces the ink tank.

In the replacement of these replaceable ink tanks, the ink supply path at the recording head and a connection opening of the ink tank are temporarily separated. Therefore, air may enter the ink supply path. The air in the ink supply path may be removed by the following cleaning operation.

First, a surface of the recording head in which a discharge opening is formed (discharge opening side) is covered with a cap, and a suction pump is driven at a high speed in order to produce a negative pressure in the cap. This causes a large negative pressure to act upon the capped discharge opening side and a high ink flow rate to be produced in the discharge opening direction from the inside of the ink supply path, causing retained air bubbles to be sucked and discharged from the discharge opening along with the ink. However, in order to sufficiently remove the gas by this method, a large amount of ink needs to be sucked and discharged. Therefore, a corresponding amount of ink is wasted.

As mentioned above, the related ink tanks are discarded before all of the ink in the ink tanks is used up. Therefore, a large amount of ink that can actually be used is wastefully discharged by the cleaning operation. In addition, when the cleaning operation is being carried out, the body of the recording apparatus cannot carry out a recording operation. Therefore, the user wastes time because he/she cannot carry out a recording operation until the cleaning operation ends. Further, a suction pump mechanism for carrying out the cleaning operation and a waste ink receiver for accommodating the sucked ink are required, thereby increasing costs and the size of the recording apparatus body accordingly.

SUMMARY OF THE INVENTION

The present invention is directed to an ink supplying system for supplying a liquid, such as ink, which does not contain a gas and without wasting the liquid by quickly removing unwanted gas from a path for supplying the liquid and by controlling the remaining amount of liquid, when, in particular, a replaceable ink tank (container) is used.

To this end, according to one aspect of the present invention, there is provided an ink supplying system comprising an ink tank for containing ink, and an ink supplying unit facilitating supplying ink from the ink tank to the recording head. The ink supplying unit includes at least first and second communication paths configured to connect with the ink tank such that the ink in the ink tank can be supplied into the ink supplying unit through the first communication path and gas in the ink supplying unit can be transported into the ink tank through the second communication path. At least one of the ink tank and the ink supplying unit has storage means for storing information regarding the amount of ink in the ink supplying system.

According to another aspect of the present invention, there is provided an ink tank for supplying ink contained therein to a recording head through an ink supplying unit having at least first and second communication paths to connect to the ink tank. The ink tank includes an ink chamber for housing an amount of ink. The ink tank further comprises storage means for storing information regarding the amount of ink in the ink chamber. The ink in the ink chamber is supplied into the ink supplying unit through the first communication path, and gas in the ink supplying unit is transported into the ink chamber through the second communication path.

According to the present invention, when, in particular, a replaceable ink tank (container) is used, gas, which is an obstacle to the use of a liquid (such as ink) and to liquid supply, can be quickly and smoothly removed from the liquid supply path having a sealed structure with respect to a device which uses the liquid, such as a recording head, without complicating the structure of the liquid supplying system. When, for example, an inkjet recording head is used as a device which uses the liquid, it is possible to prevent improper recording caused by air bubbles in the ink supply path, that is, for example, by an ink supply failure or clogging in a discharge opening.

In addition, according to the present invention, it is possible to supply a liquid, such as ink, which does not contain a gas without wasting the liquid by quickly removing unwanted gas from the path for supplying the liquid and by controlling the remaining amount of liquid by using the storage means.

Further features and advantages of the present invention will become apparent from the following description of the preferred embodiments with reference to the attached drawings.

DESCRIPTION OF THE EMBODIMENTS

Hereunder, several embodiments in which the present invention is applied to an inkjet recording apparatus will be described with reference to the drawings.

In the specification, the term "record" not only refers to forming significant information such as characters or figures, but also broadly refers to forming, for example, images, designs, or patterns on a recording medium, regardless of whether they are significant or insignificant and regardless of whether they can be seen by the user, and to processing a medium. The term "recording medium" is broadly defined as not only referring to paper used in commonly used recording apparatuses, but also to other types of media which can receive ink, such as cloths, plastic films, metallic plates, glass, ceramics, wood, and leather. Hereunder, recording medium may be referred to as sheet.

Although, in each of the embodiments below, ink is used as liquid in the present invention, the usable liquid is not limited to ink. Therefore, obviously, for example, in the field of inkjet recording, a liquid used to process a recording medium may be used.

First Embodiment

[Structure]

Figure 1:
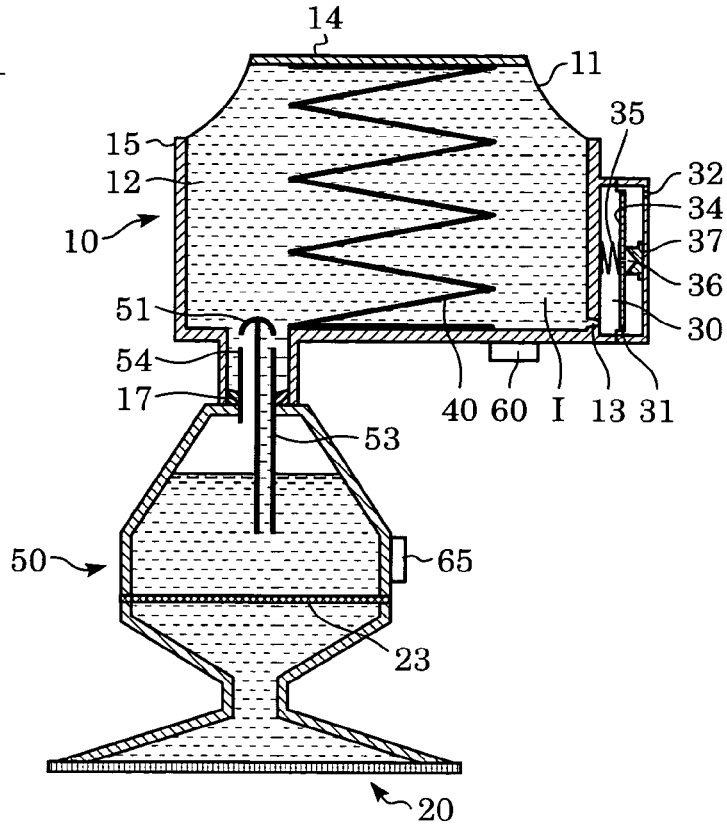
FIG. 1 is a sectional view of an ink supplying system according to a first embodiment of the present invention.

FIG. 1 is a schematic sectional view of a liquid supplying system in accordance with a first embodiment of the present invention.

The ink supplying system of the embodiment shown in FIG. 1 generally comprises an ink tank 10 (liquid container), an inkjet recording head 20 (hereafter simply referred to as "recording head 20"), and an ink supplying unit 50 which forms an ink supply path connecting the ink tank 10 and the recording head 20. The ink supplying unit 50 may be separably formed at or inseparably integrally formed with the recording head 20. Alternatively, it is possible to dispose the ink supplying unit 50 on a carriage for carrying the recording head 20 in order to form the ink supply path from the ink tank 10 to the recording head 20 when the ink tank 10 is removably mounted from above the ink supplying unit 50.

In general, the ink tank 10 has two chambers, a valve chamber 30 and an ink chamber 12 defining an ink containing space. The chambers 12 and 30 communicate with each other through a communication path 13. The ink chamber 12 contains ink I to be discharged from the recording head 20, and discharges the ink I to the recording head 20.

A flexible film (sheet) 11 is disposed at a portion of the ink chamber 12. This portion and the inflexible outer portion define the ink containing space. Space disposed at the outer side of the ink containing space as viewed from the sheet 11, that is, the space at the upper side of the sheet 11 shown in FIG. 1 is open to atmospheric air so that its pressure is equal to atmospheric pressure. The ink chamber 12 substantially defines a sealed space, other than a portion of the ink chamber 12 connected to the ink supplying unit 50 and the communicating path 13 communicating with the valve chamber 30, both of which are disposed at the lower portion of the ink chamber 12.

A storage medium 60 is disposed at the ink tank 10, and stores, for example, information regarding an initial amount of ink poured into the ink tank 10 when the ink tank 10 is being manufactured at a factory. The storage medium 60 may be a memory element, such as a commonly used electrically erasable programmable read only memory (EEPROM) or a commonly used ferroelectric random access memory (FeRAM). Other elements/means may be used as long as they are capable of writing and reading out ink amount information. Similarly, a storage medium (body storage medium) 65 is disposed at the ink supplying unit 50.

The shape of the central portion of the sheet 11 in the embodiment is regulated by a pressure plate 14, which is a flat supporting member. The peripheral portions of the sheet 11 are deformable. The sheet 11 has a central portion that is previously formed with a convex shape, and has side surfaces that are formed with a substantially trapezoidal shape. As described later, the sheet 11 is deformed in accordance with variations in pressure or changes in the ink amount in the ink containing space. Here, the peripheral portions of the sheet 11 are compressed in a balanced manner and the central portion of the sheet 11 moves vertically in parallel while it is kept substantially in a horizontal posture. Since the sheet 11 is deformed (moves) smoothly, shock is not generated by the deformation. Therefore, abnormal pressure changes do not occur in the ink containing space due to shock.

A spring 40, which is a compression spring, for biasing the sheet 11 upward in FIG. 1 through the pressure plate 14 is disposed in the ink containing space. By the pushing force of the spring 40, a negative pressure which is in equilibrium with the holding force of an ink meniscus formed at an ink discharge section of the recording head 20 and which is in a range allowing ink to be discharged from the recording head 20 is generated. In the state shown in FIG. 1, the ink containing space is substantially completely filled with ink. Even in the state shown in FIG. 1, the spring 40 is compressed, and a proper negative pressure is generated in the ink containing space.

A unidirectional valve for introducing gas (air) from the outside when the negative pressure in the ink tank 10 becomes equal to or greater than a predetermined value and for preventing leakage of ink to the outside of the ink tank 10 is disposed at the valve chamber 30. The unidirectional valve comprises a pressure plate 34, a sealing member 37, and a sheet 31. The pressure plate 34 is a valve closing member having a communication opening 36. The sealing member 37 is fixed to a location of an inside wall of a housing of the valve chamber 30 opposing the communication opening 36 and can seal the communication opening 36. The sheet 31 is joined to the pressure plate 34. The communication opening 36 passes through the sheet 31. In the valve chamber 30, a space is substantially maintained in a sealed state, other than the communication opening 13 for communication with the ink tank 10 and the communication opening 36 for communication with the outside (atmospheric air). The portion of the space in the housing of the valve chamber disposed to the right of the sheet 31 in FIG. 1 is opened to atmospheric air through an atmospheric air communication opening 32. The pressure in this portion of the space is equal to atmospheric pressure.

The peripheral portions of the sheet member 31, which are portions that are different from the central portion that is joined to the pressure plate 34, are deformable. The central portion has a convex shape, and the side surfaces have a substantially trapezoidal shape. By virtue of such a structure, the pressure plate 34 moves smoothly towards the left and right in FIG. 1.

A spring 35 serving as a valve controlling member for controlling the opening of the valve is disposed in the valve chamber 30. The spring 35 is slightly compressed. Force opposing the compression pushes the pressure plate 34 rightwards in FIG. 1. The spring 35, which is stretched and compressed, functions as a valve for causing the sealing member 37 to come into close contact with/to separate from the communication opening 36, and as a unidirectional valve for only allowing gas to be introduced into the valve chamber 30 from the atmospheric air communication opening 32 through the communication opening 36.

The sealing member 37 may be any sealing member as long as it reliably seals the communication opening 36. More specifically, for example, a sealing member having a shape that allows at least a portion thereof that comes into contact with the communication opening 36 to remain smooth with respect to the communication opening 36, a sealing member having a rib which can come into close contact with portions around the communication opening 36, a sealing member having a shape allowing its end to protrude into the communication opening 36 to close the communication opening 36, or any other sealing member which can seal the communication opening 36 may be used. The type of material which may be used to form the sealing member 37 is not particularly limited. Since the sealed state is achieved by the stretching capability of the spring 35, it is desirable for the sealing member 37 to be formed of an elastic material, such as rubber, so as to be easily movable along with the pressure plate 31 by the stretching capability of the spring 35.

In the ink tank 10 having this structure, ink is consumed from the initial state in which the ink tank 10 is sufficiently filled with ink. When the negative pressure is further increased due to continued ink consumption from the state in which the negative pressure in the ink chamber 12 is in equilibrium with, for example, the force acting in the valve chamber 30 by the valve controlling member (the spring 35), the communication opening 36 is opened and atmospheric air flows into the valve chamber 30. The atmospheric air in the valve chamber 30 causes the sheet 11 and pressure plate 14 to be displaced upward in FIG. 1. This increases the volume of the ink chamber 12, and at the same time to reduce the negative pressure in the ink chamber 12, causing the communication opening 36 to be closed again.

Even if there is a change in the environment of the ink tank, such as an increase in temperature or a decrease in pressure, air in the ink containing space is allowed to expand by an amount corresponding to the change in the volume of the ink containing space when the sheet 11 and the pressure plate 14 are displaced from the maximum lower displacement position to the initial position shown in FIG. 1. In other words, the space corresponding to the amount of change in volume functions as a buffer region, so that it reduces an increase in pressure caused by a change in the environment, and, thus, effectively prevents ink leakage from a discharge opening of the recording head 20.

Outside air is not introduced into the ink containing space until a buffer region is provided by a reduction in the internal volume of the ink containing space resulting from a discharge of ink from an initial filled state shown in FIG. 1. Therefore, even if, for example, a sudden change in the environment or vibration occurs or the ink supplying system is dropped prior to the formation of the buffer region, ink leakage does not occur. In addition, since the buffer region is not previously provided from a state in which the ink is unused, the volume efficiency of the ink tank 10 is increased, so that the ink tank 10 can be compact.

Although, in FIG. 1, the spring 40 in the ink chamber 12 and the spring 35 in the valve chamber 30 are schematically shown as coil springs, they may obviously be other types of springs, such as conical helical springs or plate springs. A pair of plate springs having substantially U shapes in cross section with open ends that face each other and are combined may be used.

In the illustrated example, the recording head 20 and the ink tank 10 are joined by inserting a connecting portion 51 of the supplying unit 50 integrally disposed with the recording head 20 into the ink tank 10. Therefore, the recording head 20 and the ink tank 10 are joined so as to allow the supply of ink to the recording head 20 from the ink tank 10. A sealing member 17, such as rubber, is mounted to an opening of the ink tank 10 in which the connecting portion 51 is inserted. The sealing member 17 prevents ink leakage from the ink tank 10 by being in close contact with the surrounding portion of the connecting portion 51, and reliably connects the connecting portion 51 and the ink tank 10. In order to easily insert the connecting portion 51, a slit or the like may be previously formed in the location of the sealing member 17 where the connecting portion 51 is to be inserted. In this case, when the connecting portion 51 is not inserted, the slit is closed by the elasticity of the sealing member 17 itself, thereby preventing ink leakage.

The connecting portion 51 is a needle-shaped member having two internal portions divided in the axial direction and having hollows. The upper sides of the hollows, that is, the opening positions (hereinafter referred to as "tank opening positions") in the ink chamber 12 are at substantially the same height in the vertical direction. In contrast, the lower sides of the hollows, that is, the opening positions (hereinafter referred to as "head opening positions") in the ink supplying unit 50 connected to the recording head 20 are at different heights. Hereunder, a path (that is, the right path in FIG. 1) where the vertically lower head opening position in the ink supplying unit 50 is situated is referred to as an ink path 53, whereas a path (that is, the left path in FIG. 1) where the vertically upper head opening position is situated is referred to as an air path 54. In the process of removing air bubbles, primarily, ink is led out to the recording head 20 from the ink path 53, and air is sent to the ink tank 10 from the air path 54. However, as described below, the ink and the air both flow in the paths 53 and 54, so that the ink path 53 and the air path 54 are not named because they pass only ink and air, respectively.

In cross section, the size of the ink supply path in the ink supplying unit 50 gradually increases downstream from the connecting portion connecting the ink tank 10 (that is, from the upstream side) up to the central portion of the ink supply path, and gradually decreases downstream from the central portion to the recording head 20 (that is, to the downstream side). A filter 23 is disposed at the largest portion of the ink supply path in order to prevent impurities in the ink supplied from the ink tank 10 from flowing into the recording head 20. The area of the gas-liquid interface formed by the gas held in the ink supplying unit 50 is greater than the horizontal sectional areas of the paths 53 and 54. Therefore, when the ink head in the ink tank 10 is such that the ink in the ink tank 10 reaches the ink in the ink supplying unit 50 through the ink path 53, the pressure of the gas in the ink supplying unit 50 is increased, thereby making it possible to easily discharge the gas from the air path 54 towards the ink tank.

The recording head 20 has a plurality of discharge openings, liquid paths communicating with the discharge openings, and energy generating elements. The discharge openings are disposed in a predetermined direction (that is, in a direction that is different from the direction of movement of the recording head 20 when it is a serial recording type which is carried by, for example, a carriage as described below and which carries out a discharge operation while moving relative to a recording medium). The energy generating elements are disposed at the respective liquid paths and generate energy for discharging ink. Here, the ink discharge method of the recording head, that is, the type of energy generating elements are not particularly limited. For example, it is possible to discharge ink by making use of thermal energy generated by electrothermal conversion members for generating heat in accordance with electrification. In this case, it is possible to discharge the ink from the ink discharge openings by forming energy generated by film boiling in the ink by heat generated by the electrothermal conversion members. In addition, it is possible to discharge ink by making use of mechanical energy by using electromechanical conversion elements, such as piezo elements which deform in accordance with the application of voltage.

The recording head 20 and the ink supplying unit 50 may be separably or inseparably integrally disposed with respect to each other, or they may be formed as separate members and connected through the communication path 51. When they are integrally formed, they may be formed as cartridges that are removable from a device (such as a carriage) to which they are mounted in a recording apparatus.

[Operation]

Next, the operation of the liquid supplying system will be described.

Figure 2:
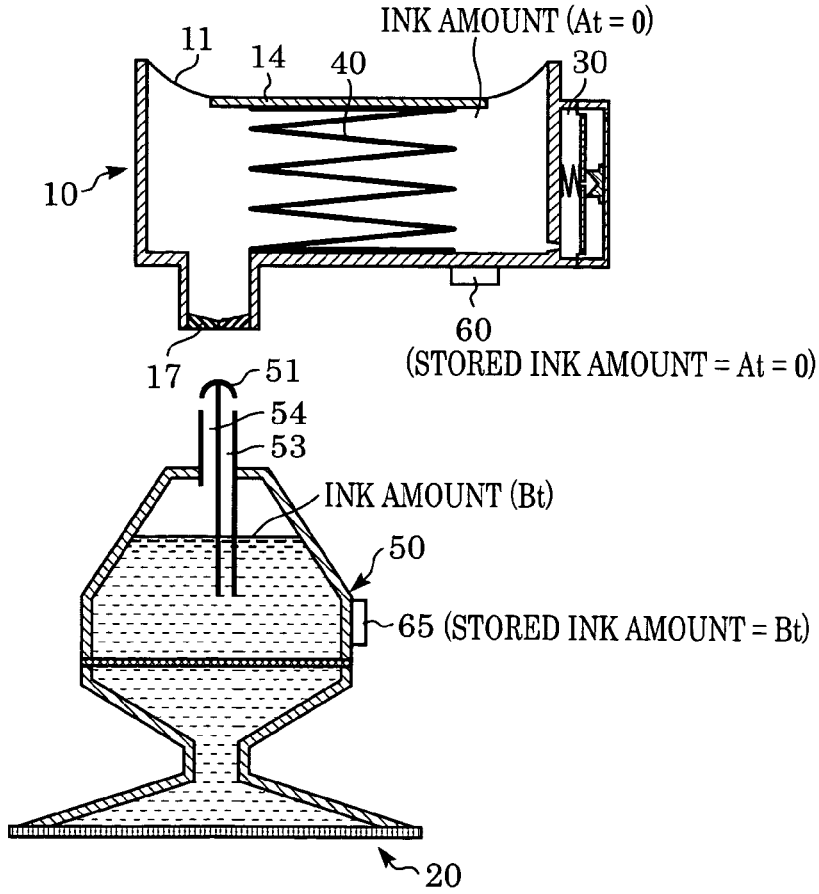
FIG. 2 is a sectional view showing a state in which an ink tank whose ink is used up is removed from the ink supplying system shown in FIG. 1.

FIG. 2 shows a state in which the ink tank 10, whose ink is depleted, is removed. At this time, the storage medium 65 stores a residual ink amount Bt in the ink supplying unit 50. Since the ink tank 10 is empty, the storage medium 60 stores an ink amount "0" (At=0) by the recording apparatus as described below.

Figure 3:
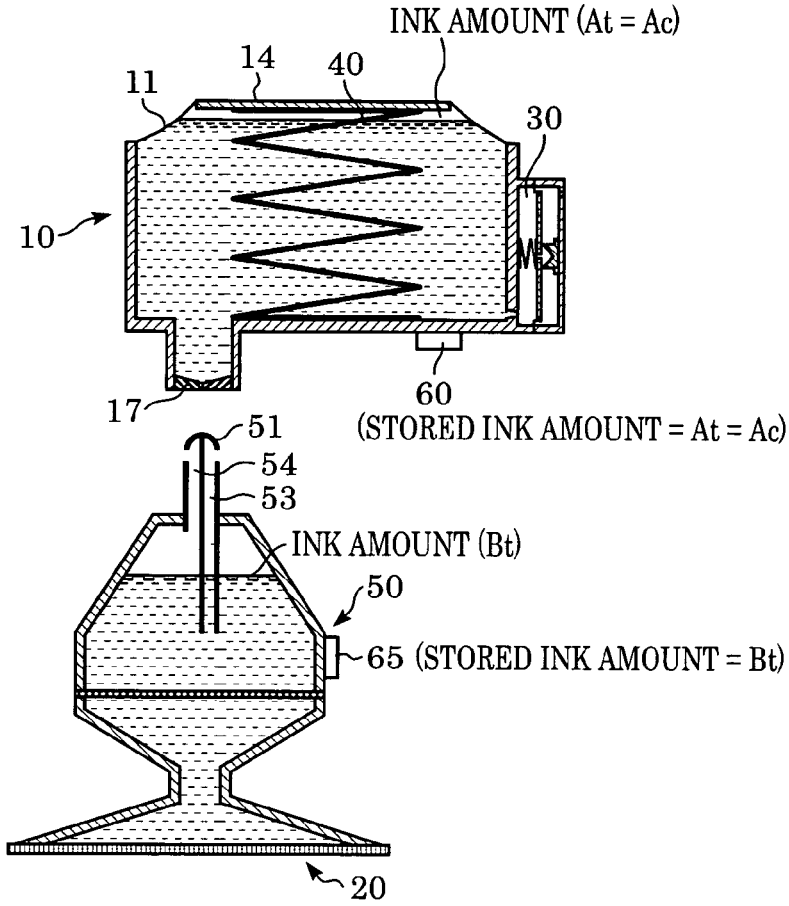
FIG. 3 is a sectional view showing a state prior to mounting a new ink tank in the ink supplying system shown in FIG. 1.

FIG. 3 shows a state in which a new ink tank 10 is being mounted in place of the ink tank 10 whose ink is used up shown in FIG. 2. At this time, a storage medium 60 stores a predetermined ink amount Ac that has been poured during the manufacturing of the ink tank 10. Here, the ink amount At in the ink tank 10 is Ac. The ink tank 10 shown in FIG. 3 has a small amount of gas, such as air, in an ink chamber 12 when it is being manufactured. However, the fact that a slight amount of gas is contained in the ink tank 10 is not particularly a problem.

Figure 4:
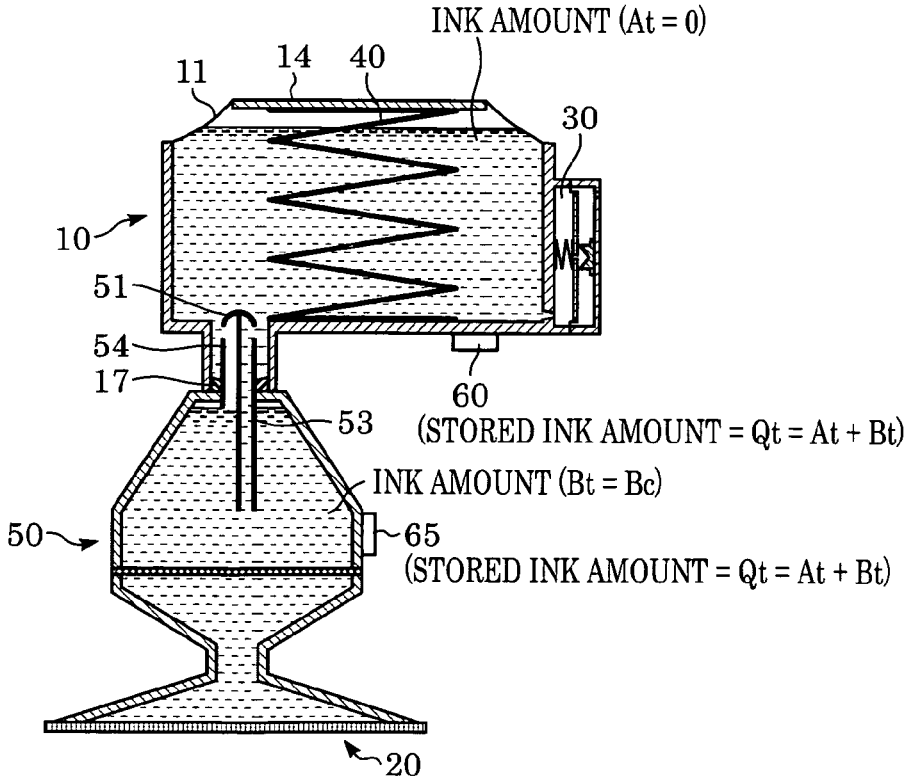
FIG. 4 is a sectional view showing a state after mounting the new ink tank in the ink supplying system shown in FIG. 1.

FIG. 4 shows a state in which the mounting of the new ink tank 10 shown in FIG. 3 is completed. As mentioned below, at this time, in the recording apparatus, the storage medium 60 and the storage medium 65 store an ink amount Qt which can be used for recording (hereinafter referred to as "recordable ink amount"). The recordable ink amount Qt is the sum of the ink amount At (=Ac) stored on the storage medium 60 shown in FIG. 3 and the ink amount Bt stored on the storage medium 65 shown in FIGS. 2 and 3, that is, Qt=At+Bt. At this time, gas in the ink supplying unit 50 is replaced by ink in the ink tank 10 (the replacement mechanism is described in detail below), so that the ink level in the ink supplying unit 50 is always kept at the lower end of the air path 54 as shown in FIG. 4.

Figure 5:
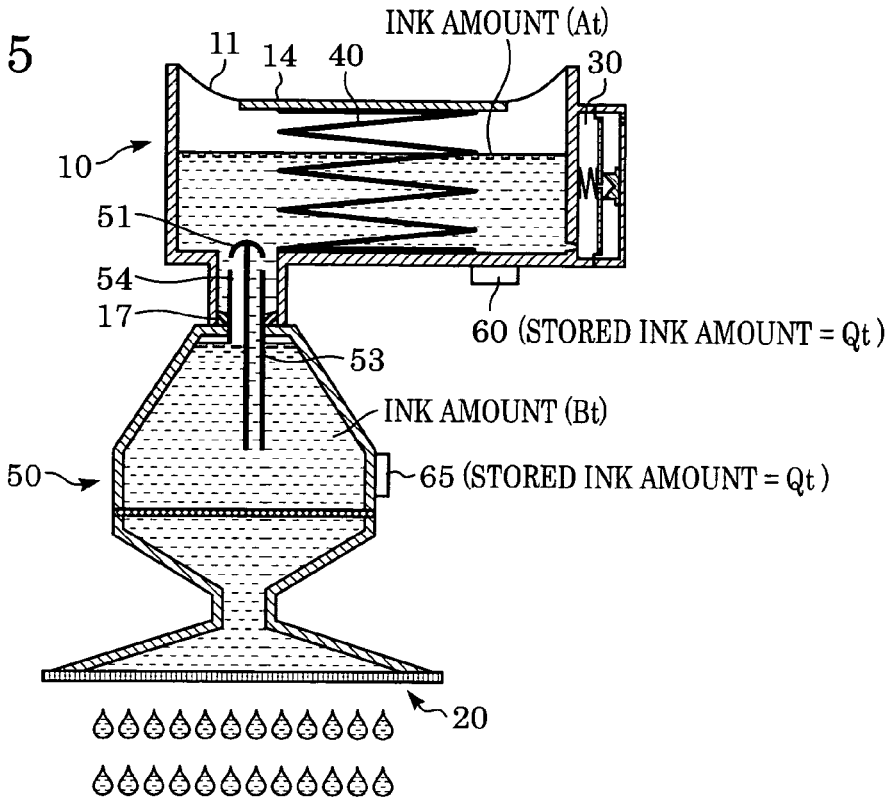
FIG. 5 is a sectional view showing a state in which ink in the ink tank is being consumed in the ink supplying system shown in FIG. 1.

FIG. 5 shows a state in which a predetermined amount of the ink in the ink tank 10 is consumed by a recording operation from the state shown in FIG. 4. When a user carries out a recording operation with the recording apparatus from the state shown in FIG. 4, the ink in the ink tank 10 is supplied to the recording head 20, and is discharged in the form of drops from the recording head 20. As mentioned below, the recording apparatus calculates the ink volume (consumed ink amount) discharged from the recording head 20 by multiplying the volume of ink drops to the quantity data of the ink drops discharged from the recording head 20 and subtracts the calculated ink volume from the recordable ink amount Qt in order to update the recordable ink amount Qt on the storage medium 60 and the storage medium 65 by using this new recordable ink amount Qt as required.

Figure 6:
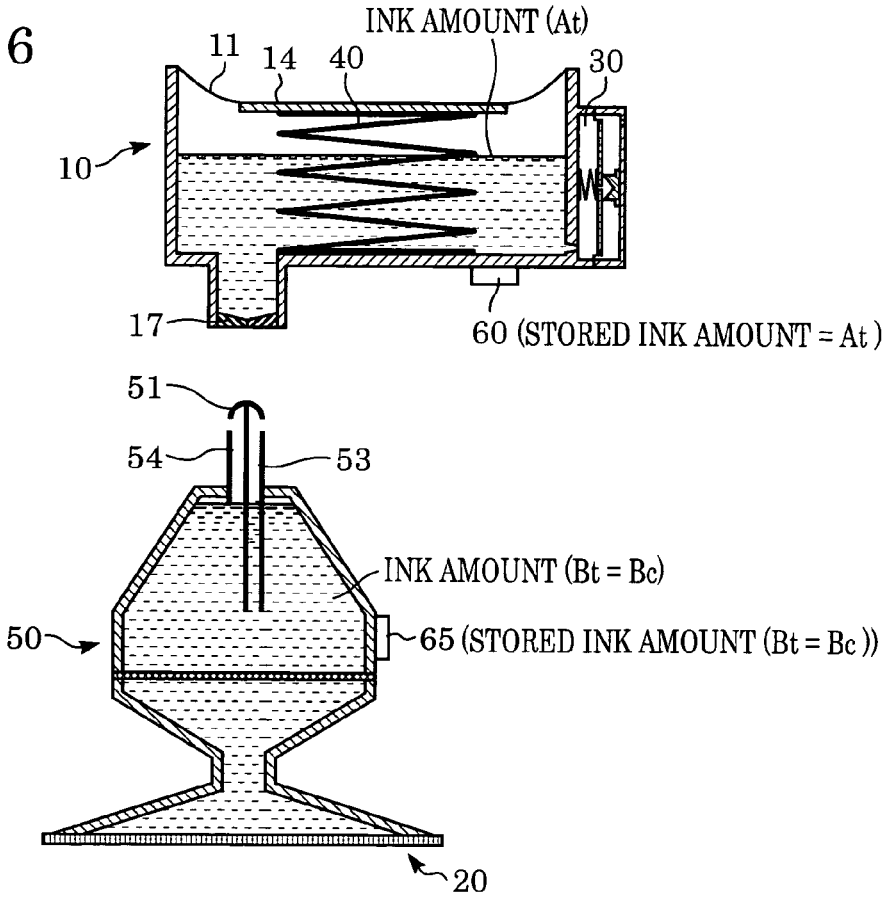
FIG. 6 is a sectional view showing a state in which the ink tank whose ink is partly consumed is removed in the ink supplying system shown in FIG. 1.

FIG. 6 shows a state in which the ink tank 10 whose ink is partly consumed in the state shown in FIG. 5 is temporarily removed. Since the ink level in the ink supplying unit 50 is always kept at the lower end of the air path 54, the ink amount in the ink supplying unit 50 remains constant. Therefore, the recording apparatus causes the storage medium 65 to store an ink amount Bc (hereinafter referred to as "maintained ink amount") as the ink amount Bt in the ink supplying unit 50. The ink amount Bc allows the ink level to be positioned at the lower end of the air path 54. The storage medium 60 stores the ink amount At obtained by subtracting the maintained ink amount Bc from the recordable ink amount Qt in the state shown in FIG. 5 (At=Qt−Bc).

When the ink tank 10 shown in FIG. 6 is re-mounted, the ink tank 10 is restored to the state shown in FIG. 5. The maintained ink amount Bc stored on the storage medium 65 and the ink amount At (=Qt−Bc) stored on the storage medium 60 are added in order to calculate the recordable ink amount Qt. The calculated recordable ink amount Qt is stored on the storage medium 65 and the storage medium 60.

Accordingly, when the ink tank 10 is removed, the ink amount At in the ink tank 10 is stored on the storage medium 60 at the ink tank 10. Therefore, regardless of whether or not the ink tank 10 is full when the ink tank 10 is mounted, the recording apparatus can calculate the recordable ink amount Qt based on the ink amount At stored on the storage medium 60 at the ink tank 10 and the maintained ink amount Bc stored on the storage medium 65.

Figure 7:
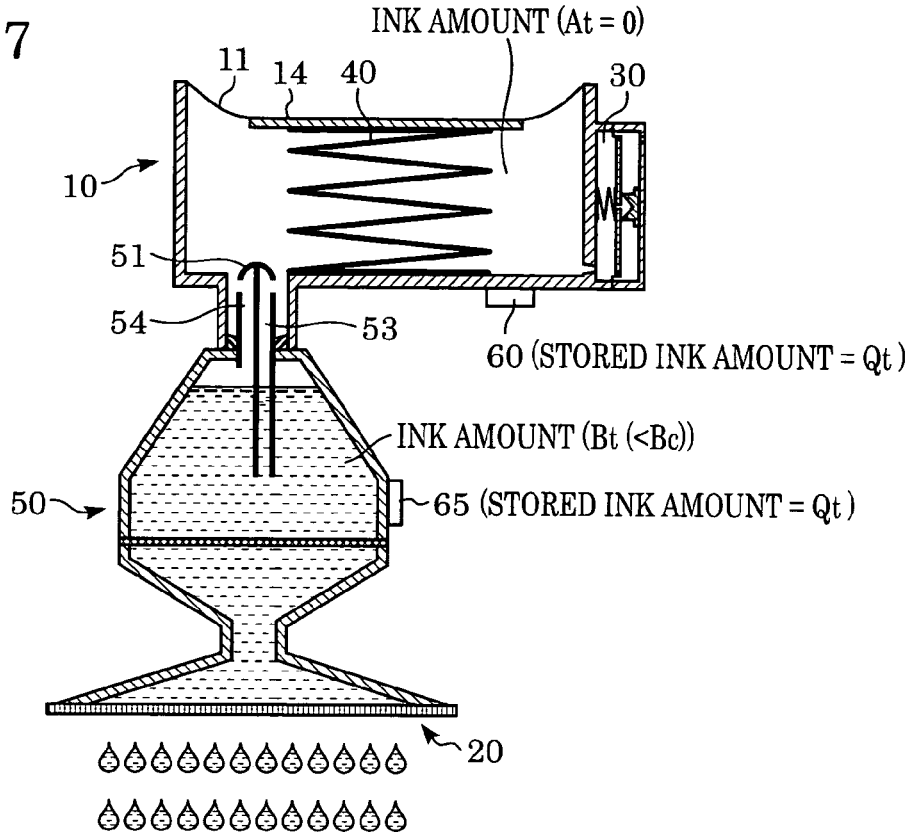
FIG. 7 is a sectional view showing a state in which the ink in the ink tank is used up in the ink supplying system shown in FIG. 1.

FIG. 7 shows a state in which the ink in the ink tank 10 is used up by further consumption of the ink from the state shown in FIG. 5. The ink in the ink tank 10 is consumed from the state shown in FIG. 5 when the user carries out a recording operation with the recording apparatus. As mentioned above, the ink volume (consumed ink amount) discharged from the recording head 20 is calculated by multiplying the volume of ink drops to the quantity data of the ink drops discharged from the recording head 20, and by the calculated ink volume is subtracted from the recordable ink amount Qt in order to update the recordable ink amount Qt on the storage medium 60 and the storage medium 65 by using the new recordable ink amount Qt as required.

Here, since the ink amount Ac poured into the ink tank 10 when it is manufactured is constant, it is possible to determine whether or not the ink in the ink tank 10 is completely used up by comparing the ink amount Ac and the recordable ink amount Qt. As in the state shown in FIG. 7, when the ink in the ink tank 10 is completely used up, it is possible to prompt the user to replace the ink tank 10 by informing him/her that the ink is completely used up. A recording operation can be carried out even in the state shown in FIG. 7. When the user provides a new ink tank 10 during this recording operation, it is possible to avoid the problem of the recording apparatus becoming unusable because the ink tank 10 has run out of ink. Therefore, time is not wasted.

Figure 8:
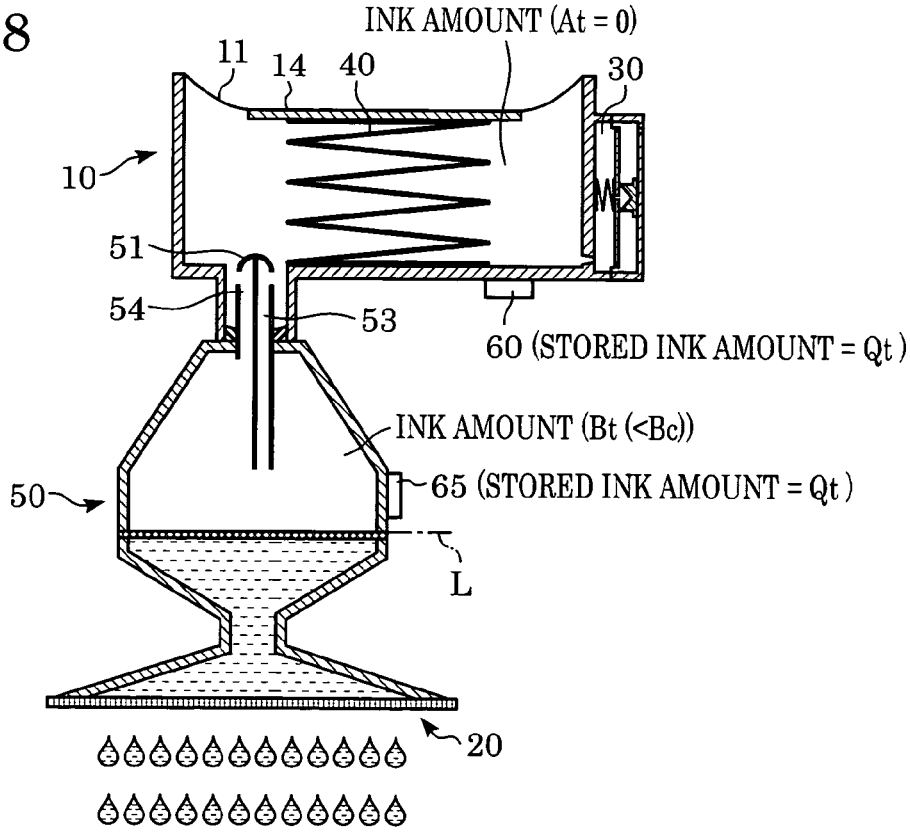
FIG. 8 is a sectional view showing a state in which ink in an ink supplying unit is being used up in the ink supplying system shown in FIG. 1.

FIG. 8 shows a state just before the ink in the ink supplying unit 50 is used up as a result of further consumption of the ink from the state shown in FIG. 7. The ink in the ink supplying unit 50 is consumed from the state shown in FIG. 7 by a recording operation carried out by the user with the recording apparatus. As mentioned above, the ink volume (consumed ink amount) discharged from the recording head 20 is calculated by multiplying the volume of ink drops to the quantity data of the ink drops discharged from the recording head 20 and the calculated ink volume is subtracted from the recordable ink amount Qt in order to update the recordable ink amount Qt by using the new recordable ink amount Qt. Therefore, when the recordable ink amount Qt is near "0," it is possible to determine whether or not the ink supplying unit 50 is in a state just before its ink is completely used up as in FIG. 8. When a determination is made that the ink supplying unit 50 is in the state just before its ink is completely used up, the recording apparatus is stopped before the ink level reaches the filter 23 or the user is prompted to replace the ink tank 10 with a new ink tank 10 by notifying him/her that the ink is running out.

Accordingly, it is possible to replace the ink tank 10 during a time in which the recording apparatus can carry out a recording operation, that is, during the time from the state in which the ink in the ink tank 10 is used up to the state in which the liquid level in the ink supplying unit 50 reaches a level L at which the ink surface contacts the filter 23. Gas in the ink supplying unit 50 is discharged to the ink tank 10 through the connecting tube 51, and the user is prompted to replace the ink tank 10 before the residual ink amount is reduced to that which may allow air in the ink supplying unit 50 to mix with the ink supplied to the recording head 20. Therefore, it is not necessary to carry out a cleaning operation for discharging air mixed with the ink along with the ink, so that it is possible to completely use up the ink in the ink tank 10. When the ink tank 10 is replaced, a recording operation can be carried out immediately after replenishing the ink supplying unit 50 with ink while quickly discharging the air in the ink supplying unit 50 to the ink tank 10. As a result, problems associated with related ink tanks, such as the ink tank being discarded before the ink in the ink tank is used up or the ink being wasted as a result of discharging a large amount of ink by the cleaning operation are overcome, so that the ink which is discarded or wasted in related ink tanks can be effectively used for recording an image. Since the cleaning operation is not required, it is possible to reduce the time wasted by temporarily stopping a recording operation.

In addition, since the cleaning operation is not required, a suction pump mechanism and a waste ink receiver for accommodating the suctioned ink, which are mentioned above, are not required, thereby reducing costs of the recording apparatus body and saving space.

Accordingly, according to the present invention, it is possible to restore the recording apparatus to a recordable state while completely using up ink in a replaceable ink tank and without carrying out a cleaning operation which wastes ink.

[Automatic Return To Recordable State]

Figure 9:
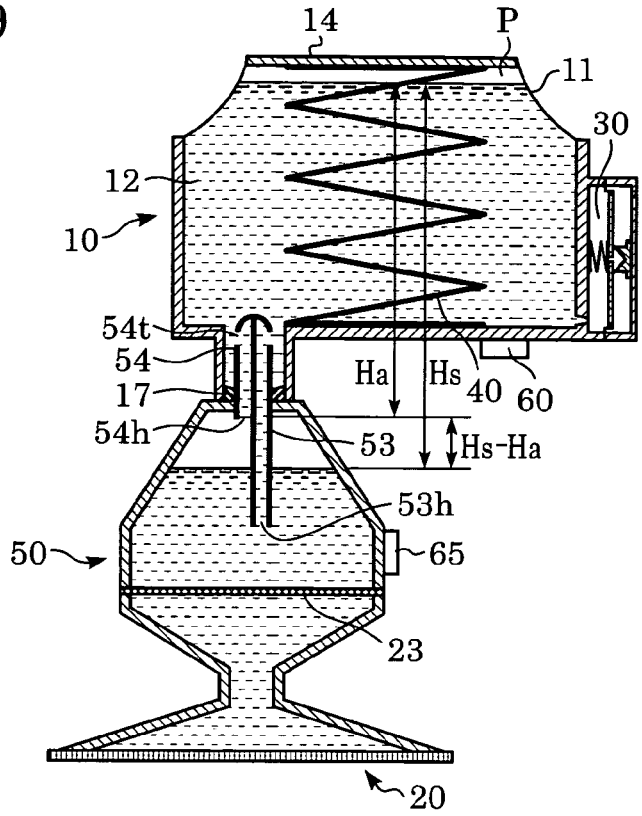
FIG. 9 is a sectional view for explaining the principle of gas discharge and ink movement in the ink supplying system shown in FIG. 1.

Next, the process to automatic return to a recordable state from the time in which the ink tank is replaced or a new ink tank is mounted in the embodiment will be described with reference to FIGS. 9 and 10. First, pressure balance at each portion will be described with reference to FIG. 9. The state shown in FIG. 9 is that in which ink flows to the ink supplying unit 50 from the ink tank 10 and air is discharged to the ink tank 10 from the ink supplying unit 50. In the description below, it is assumed that they are still in the state shown in FIG. 9.

The pressure of gas in an upstream region of the filter 23 is considered. When the gas pressure in the ink chamber 12 is P and the pressure that is produced by the head between the ink interface in the ink chamber 12 and the ink interface at the filter upstream region is Hs, the pressure of the gas in the upstream region of the filter 23 is equal to P+Hs, and, thus, is greater than the pressure P of the gas in the ink chamber 12 by Hs. This means that there is an increase in pressure because the ink supplying unit 50 is a sealed structure other than a portion of connection of the recording head 20 and the ink tank 10.

Next, pressure balance at a meniscus position at a head opening 54*h* of the air path 54 will be considered. At the meniscus position, a downwardly acting pressure is equal to P+Ha, and an upwardly acting pressure is equal to the aforementioned gas pressure P+Hs. Since, here, it is assumed that these two pressures are in equilibrium, the difference between the upward and downward pressures and a pressure Ma represented by the following Expression (1) and produced by the meniscus are in equilibrium. Ha is the pressure that is produced by the head between the ink interface in the ink chamber 12 and the meniscus formed at the head opening 54*h* of the air path 54.

$$Ma=2\gamma \cos \theta a/Ra \quad (1)$$

Here, γ represents the surface tension of the ink, θa represents the angle of contact of the ink with the air path 54, and Ra represents the inside diameter of the air path 54.

Therefore, the pressure balance at the location of the head opening 54*h* of the air path 54 is expressed by the following Expressions (2) and (3).

$$P+Hs-(P+Ha)=Ma \quad (2)$$

$$Hs-Ha=Ma \quad (3)$$

In other words, the pressure produced by the head between the meniscus at the air path 54 and the ink interface at the filter upstream region and the pressure produced by the meniscus at the air path are in equilibrium.

Therefore, when the volume of the residual gas at the filter upstream region is large, so that $$Hs-Ha>Ma \quad (4)$$

the meniscus at the air path 54 is broken because the gas pressure in the filter upstream region is high, as a result of which the air in the ink supplying unit 50 flows towards the ink chamber 12. This causes the ink in the ink chamber 12 to flow into the ink supplying unit 50 through the ink path 53, thereby raising the ink level in the ink supplying unit 50.

Since the volume of the air path 54 is very small compared to the volume of the ink supplying unit 50, at an initial stage in which the air starts flowing, the increase in the ink level in the ink supplying unit 50 having a relatively large volume is not very high. In contrast, the meniscus at the air path 54 moves quickly towards the location of an ink tank opening 54*t*. Therefore, the pressure (=Hs−Ha) produced by the head between an ink tank opening 54*t* at the air path 54 and the ink interface at the filter upstream region is considerably greater than the pressure Ma produced by the meniscus at the air path 54, so that the discharge (flow) of air is accelerated.

When a pressure La produced by the head equal to the length of the air path 54 is expressed by $$La<Ma+Ma' \quad (5)$$

the air is discharged until the state shown in FIG. 4 is reached (where Ma' is the pressure produced by the meniscus at the tank opening 54*t* of the air path 54).

In the foregoing discussion, the case in which a head opening 53*h* of the ink path 53 is in contact with the ink as shown in FIG. 9 is considered. Next, the state in which the head opening 53*h* of the ink path 53 no longer contacts the ink in the ink supplying unit 50 due to further consumption of the ink as shown in FIG. 10 will be described.

In FIG. 1 to FIGS. 7 and 9, since the head opening 53*h* of the ink path 53 is in contact with the ink, it is sufficient to consider only the pressure balance at the position of the meniscus in the air path 54. However, in the state shown in FIG. 10, the meniscus formed at the ink path 53 must also be considered.

Figure 10:
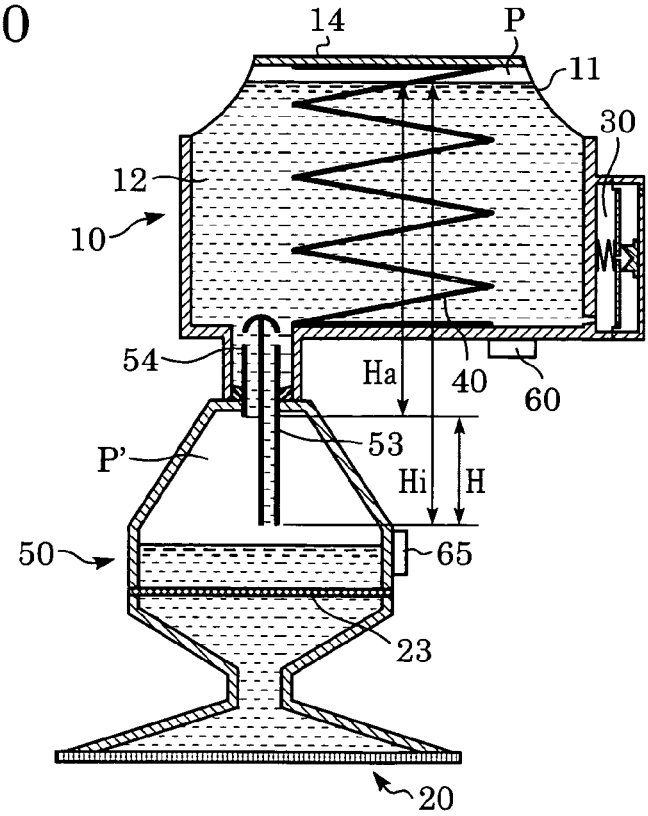
FIG. 10 is a sectional view for explaining the principle of gas discharge and ink movement in a state of the ink supplying system shown in FIG. 1 that is different from the state shown in FIG. 9.

It is assumed that ink and gas are still in the state shown in FIG. 10, and that the pressure of the gas in the ink supplying unit 50 is P' and the pressure produced by the meniscus in the ink path 53 is Mi. When they are still, the pressure balance at the location of the meniscus at the air path 54 and the location of the meniscus at the ink path 53 is represented by the following Expression (6), and gas-liquid exchange does not occur between the ink tank 10 and the ink supplying unit 50.

$$P'-(P+Ha)=Ma,\ P'-(P+Hi)=Mi \quad (6)$$

Therefore, in order to discharge the air and make the ink flow, P'−(P+Ha)>Ma and P'−(P+Hi)<Mi are satisfied.

Therefore, P'−P>Ha+Ma, P'−P<Hi+Mi.

That is, $$Hi+Mi>Ha+Ma$$

$$Hi-Ha=H>Ma-Mi \quad (7)$$

Therefore, whether or not the ink flows and the air is discharged are determined by the relationship between a pressure difference H (resulting from the head between the head opening 53*h* of the path 53 and the head opening 54*h* of the path 54) and the difference between the pressure of the meniscus at the air path 54 and the pressure of the meniscus at the ink path 53. Therefore, it is possible for the ink to flow and the air to be discharged by properly adjusting the negative pressure in the ink supplying unit 50 by, for example, sucking and discharging the ink from the discharge opening side or discharging the ink by the recording head 20.

As described above, according to the present invention, it is possible to quickly send the gas held at the filter upstream region in the ink supplying unit 50 towards the ink tank 10 by making the difference between the position of the head opening 53*h* of the path 53 and the position of the head opening 54*h* of the path 54 in the height direction different. The two paths 53 and 54 are formed by dividing the internal portion of the connecting portion 51 in two.

In addition, by, for example, sucking a small amount of ink from the discharge opening side or discharging a small amount of ink by the recording head 20, it is possible to quickly and smoothly send the gas held in the ink supplying unit 50 towards the ink tank 10 in order to remove the gas from the ink supply path. In this case, a large amount of ink is not consumed as when the above-described cleaning operation is carried out in order to remove the gas by a sucking operation from the discharge openings of the recording head 20.

When the negative pressure in the ink chamber 12 becomes equal to or greater than a predetermined value during the ink supply from the ink tank 10, gas flows into the ink chamber 12 from the outside by the operation of the valve chamber 30 as mentioned above.

[Controlling System of Recording Apparatus]

Figure 11:
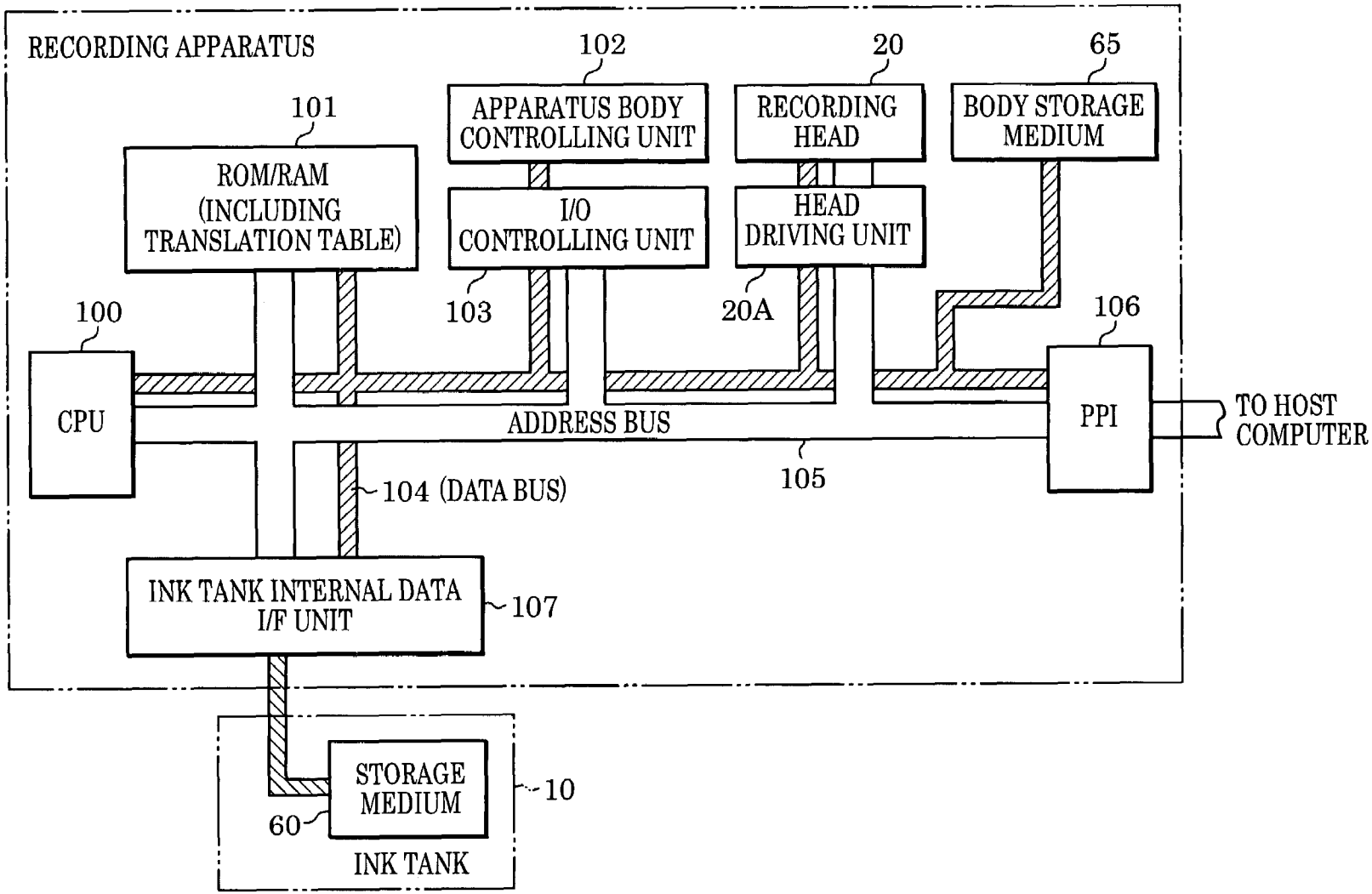
FIG. 11 is a block diagram of a control system of an inkjet recording apparatus in accordance with the first embodiment of the present invention.
Figure 12:
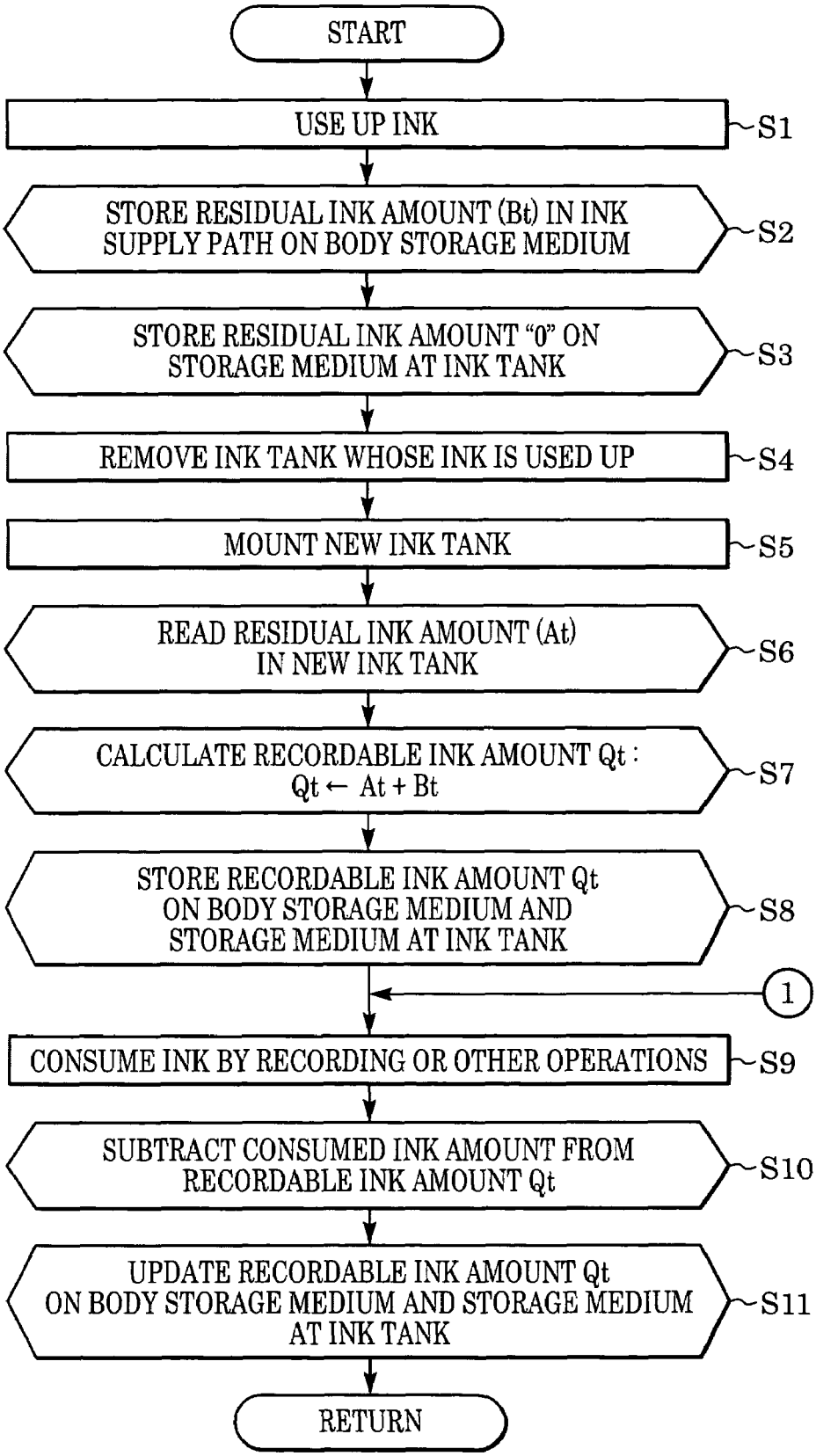
FIG. 12 is a flowchart for illustrating processing steps in accordance with the first embodiment of the present invention.
Figure 13:
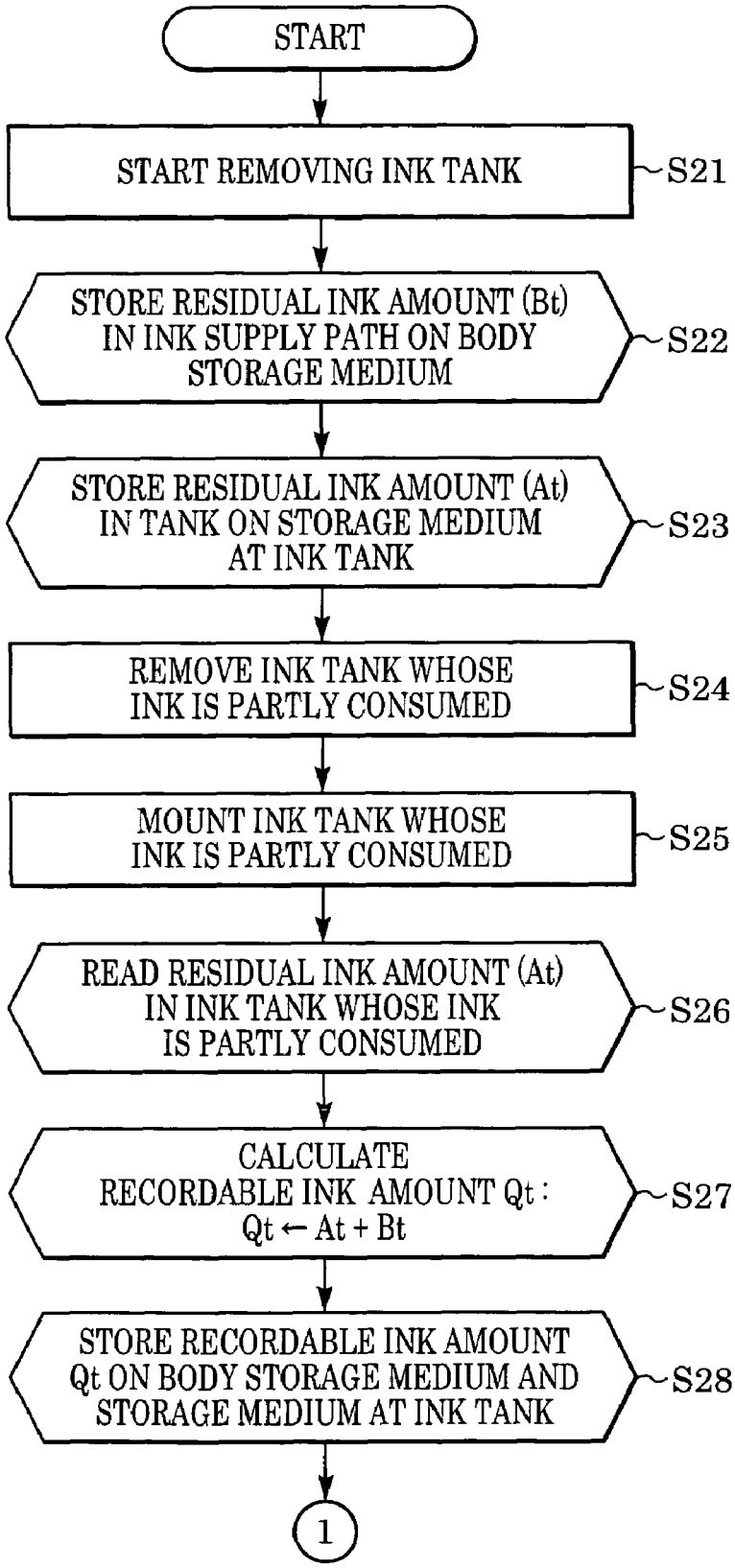
FIG. 13 is a flowchart for illustrating other processing steps in accordance with the first embodiment of the present invention.

FIG. 11 is a schematic block diagram of a control system of a recording apparatus for recording an image by the recording head 20 in the embodiment. FIGS. 12 and 13 are flowcharts for illustrating the aforementioned processing steps that are executed by the recording apparatus.

In FIG. 11, a CPU 100 controls the operations of the recording apparatus, processes data, etc. In a storage unit 101 comprising ROM and RAM, the ROM stores the program of, for example, the processing steps of the CPU 100, and the RAM is used as a work area for executing these processing steps. An apparatus body controlling unit 102 comprises an operating section for controlling the recording apparatus. The CPU 100 executes the processing steps by receiving a command from the apparatus body controlling unit 102 through an I/O controlling unit 103. Reference numeral 104 denotes a data bus, and reference numeral 105 denotes an address bus. The recording head 20 is controlled through a head driving unit 20A. Based on image data received from a host computer through a programmable printer interface (PPI) 106, the CPU 100 controls the recording head 20 in order to record an image. The storage medium 65 is disposed at the ink supplying unit 50 adjacent to the recording head 20 in the above-described structure, and the storage medium 60 at the ink tank 10 is connected to the CPU 100 through an ink tank internal data I/F unit 107.

FIG. 12 is a flowchart of the processing steps that are executed from the state shown in FIG. 2 to the state shown in FIG. 5.

When the ink in the ink tank 10 is used up/depleted as shown in FIG. 2 (Step S1), as mentioned above, the residual ink amount Bt in the ink supplying unit 50 (ink supply path) is stored on the storage medium 65 (Step S2), and the residual ink amount At in the ink tank 10 is stored on the storage medium 60 as "0" (Step S3). As shown in FIG. 2, the ink tank 10 whose ink is used up is removed (Step S4), and a new ink tank 10 is mounted as shown in FIGS. 3 and 4 (Step S5). Then, the ink amount At in the new ink tank 10 is read out from the storage medium 60 (Step S6). This ink amount At and the ink amount Bt in the ink supplying unit 50 stored on the storage medium 65 are added in order to determine the recordable ink amount Qt (Step S7). This recordable ink amount Qt is stored on the storage medium 65 and the storage medium 60 (Step S8). Thereafter, when the ink is consumed by a recording operation and other operations as shown in FIG. 5 (Step S9), as mentioned above, the consumed amount of ink is subtracted from the recordable ink amount Qt (Step S10). The resulting value is used to update the recordable ink amount Qt stored on the storage medium 65 and the storage medium 60 (Step S11).

FIG. 13 is a flowchart illustrating the processing steps that are executed when the ink tank 10 whose ink is partly consumed is mounted and removed as shown in FIGS. 5 and 6.

When the removal of the ink tank 10 is started (Step S21), as mentioned above, the residual ink amount Bt in the ink supplying unit 50 (ink supply path) is stored on the storage medium 65 (Step S22), and the residual ink amount At in the ink tank 10 is stored on the storage medium 60 (Step S23). Then, the ink tank 10 whose ink is partly consumed is removed as shown in FIG. 6 (Step S24), and an ink tank 10 whose ink is similarly partly consumed is mounted as shown in FIG. 5 (Step S25). The ink tank 10 that is mounted may be the ink tank 10 shown in FIG. 6. Thereafter, the ink amount At in the ink tank 10 whose ink is partly consumed is read from the storage medium (Step S26), and the ink amount At and the ink amount Bt in the ink supplying unit 50 and stored on the storage medium 65 are added to determine the recordable ink amount Qt (Step S27). This recordable ink amount Qt is stored on the storage medium 65 and the storage medium 60 (Step S28). Thereafter, the process proceeds to Step S9 in FIG. 12.

Second Embodiment

A second embodiment of the present invention will be described with reference to FIGS. 14 and 15. Corresponding parts to those in the first embodiment are given the same reference numerals.

Figure 14:
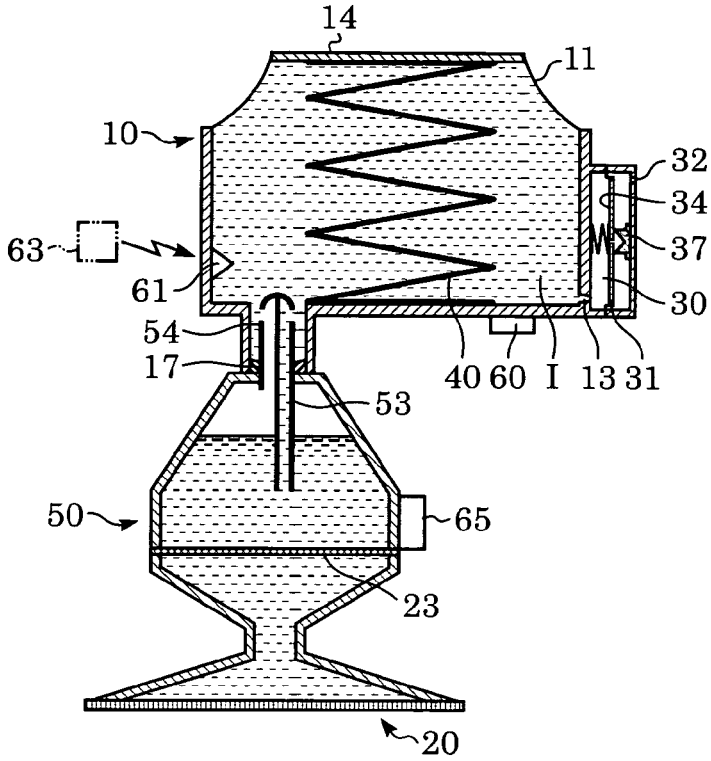
FIG. 14 is a sectional view of an ink supplying system in accordance with a second embodiment of the present invention.
Figure 15:
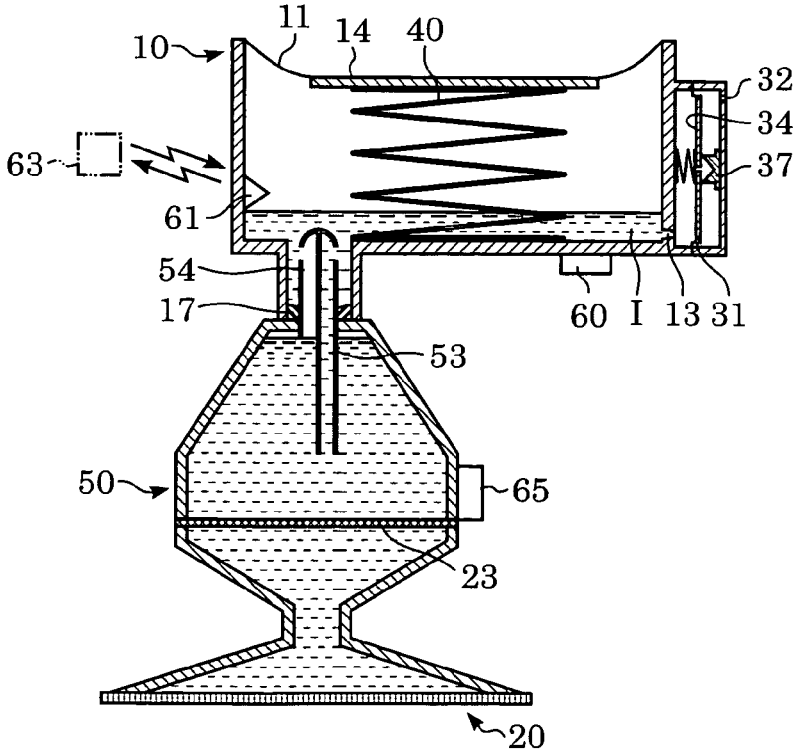
FIG. 15 is a sectional view showing a state in which a residual ink amount in an ink tank is small in the ink supplying system shown in FIG. 14.

FIG. 14 is a schematic sectional view showing a form in which an optical ink level detecting prism 61 (an ink level detecting mechanism using electrodes as in a third embodiment described below may be used instead) is provided at the ink tank 10 in the first embodiment. An optical sensor 63 is mounted at a location of the ink tank 10 or the body of a recording apparatus in correspondence with the prism 61. When there is ink around the prism 61 as shown in FIG. 14, light from the optical sensor 63 passes through the ink without being reflected by the prism 61. In contrast, if there is no ink around the prism 61 as shown in FIG. 15, the light from the optical sensor 63 is reflected by the prism 61 and returns to the optical sensor 63. Therefore, the recording apparatus determines whether or not the ink level in the ink tank 10 is at the surface of the prism 61 on the basis of whether or not the light is reflected from the prism 61 to the optical sensor 63.

Hereunder, the operation of the ink tank 10 having such an ink level detecting mechanism will be described.

When the ink level in the ink tank 10 is above the position of the prism 61 as shown in FIG. 14, the light from the optical sensor 63 at the ink tank 10 or at the body of the recording apparatus passes through the ink without being reflected by the interface between the prism 61 and the ink. In such a state, for example, the residual ink amount or the recordable number of sheets, etc. is displayed for the user on the basis of the information (recordable ink amount Qt) on the storage medium 60.

When the ink level is lowered to or below the center of the prism 61 as a result of consumption of the ink in the ink tank 10 by, for example, a recording operation, the light is reflected by the prism 61 and returns to the optical sensor 63. Therefore, it is possible to detect that the ink level is lowered in an absolute sense. Consequently, it is possible to uniquely calculate the recordable ink amount Qt at this time and to correct the recordable ink amount Qt stored on the storage medium 60 based on the calculated recordable ink amount Qt.

Thereafter, as mentioned above, when a detection is made that all of the ink in the ink tank 10 is used up based on the recordable ink amount Qt, the user is informed that the ink tank 10 is replaceable and of the number of recordable sheets up to the time the recording operation stops. When the user replaces the ink tank 10, the recording apparatus is restored to a recordable state as in the first embodiment. The ink level when the ink in the ink tank 10 is used up may be detected by using the prism 61 and the optical sensor 63.

The addition of means for correcting the ink amount stored on the storage medium 60 makes it possible to precisely correct an error in the ink amount stored on the storage medium 60 with respect to the actual ink amount. The error occurs due to, for example, an environment in which ink continues to evaporate as a result of high temperature or low humidity, or due to an unexpected mixture of gas. In other words, it is possible to precisely correct an error in the residual ink amount in the ink tank 10, obtained from the recordable ink amount Qt stored on the recording medium 60 as mentioned above, with respect to the actual residual ink amount in the ink tank 10.

Third Embodiment

Figure 16:
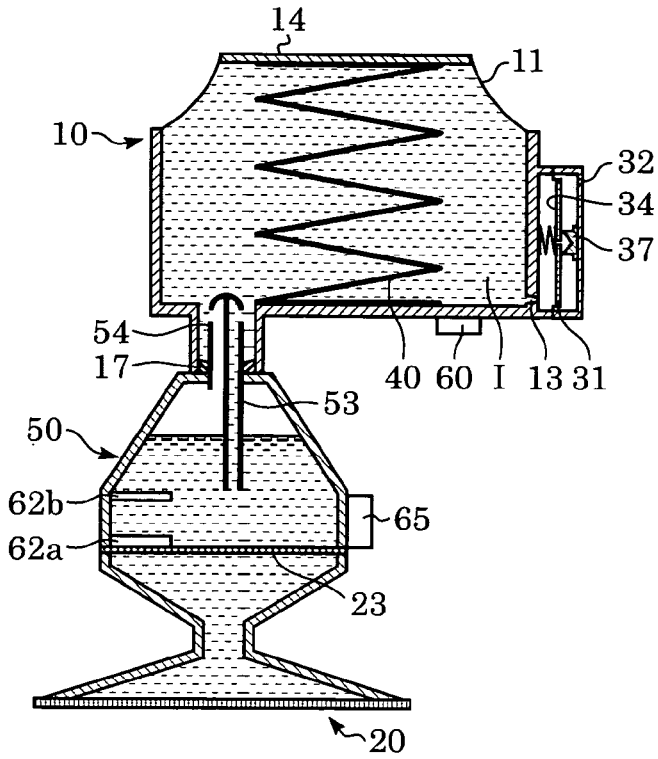
FIG. 16 is a sectional view of an ink supplying system in accordance with a third embodiment of the present invention.
Figure 17:
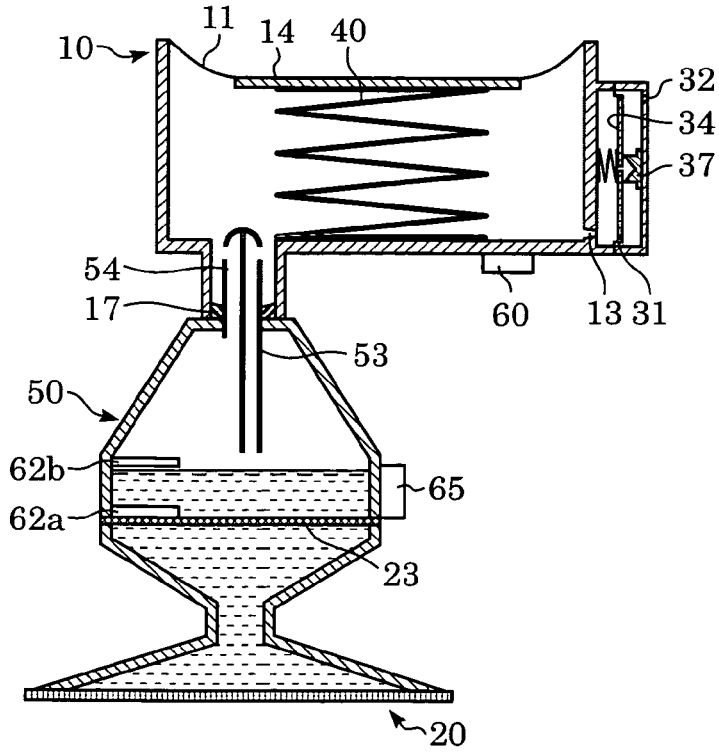
FIG. 17 is a sectional view showing a state in which a residual ink amount in an ink supplying unit is small in the ink supplying system shown in FIG. 16.

The third embodiment of the present invention will be described with reference to FIGS. 16 and 17. Corresponding parts to those in the first embodiment are given the same reference numerals.

In the third embodiment, an ink level detecting mechanism is disposed in the ink supplying unit 50. Electrode pins 62*a* and 62*b* are used for the ink level detecting mechanism. As in the second embodiment, an optical detecting mechanism may be used.

The electrode pins 62*a* and 62*b* are disposed at fixed positions in the ink supplying unit 50, and are connected to a recording apparatus. The electrical resistance between the electrode pins 62*a* and 62*b* changes considerably depending upon whether or not the portion between them is filled with ink as shown in FIGS. 16 and 17, respectively. When the ink level is lowered to the position of the upper electrode pin 62*b* as shown in FIG. 17, there is no longer ink which has been electrically connecting the electrodes 62*a* and 62*b*, as a result of which the electrical resistance between the electrodes 62*a* and 62*b* is considerably increased. Therefore, the recording apparatus determines that the ink level is lowered to the position of the electrode 62*a* and calculates the residual ink amount from the liquid level in order to correct the ink amount recorded on the recording medium 60.

In the embodiment, in order to detect the ink level in the ink supplying unit 50, the ink tank 10 may be removed and mounted without hindering the recording operation even when the ink level is lowered to a position in the ink supplying unit 50. Even when an ink tank containing a very small amount of residual ink is mounted, the error in the recordable ink amount can be precisely corrected.

Example of Structure of Inkjet Recording Apparatus

Figure 18:
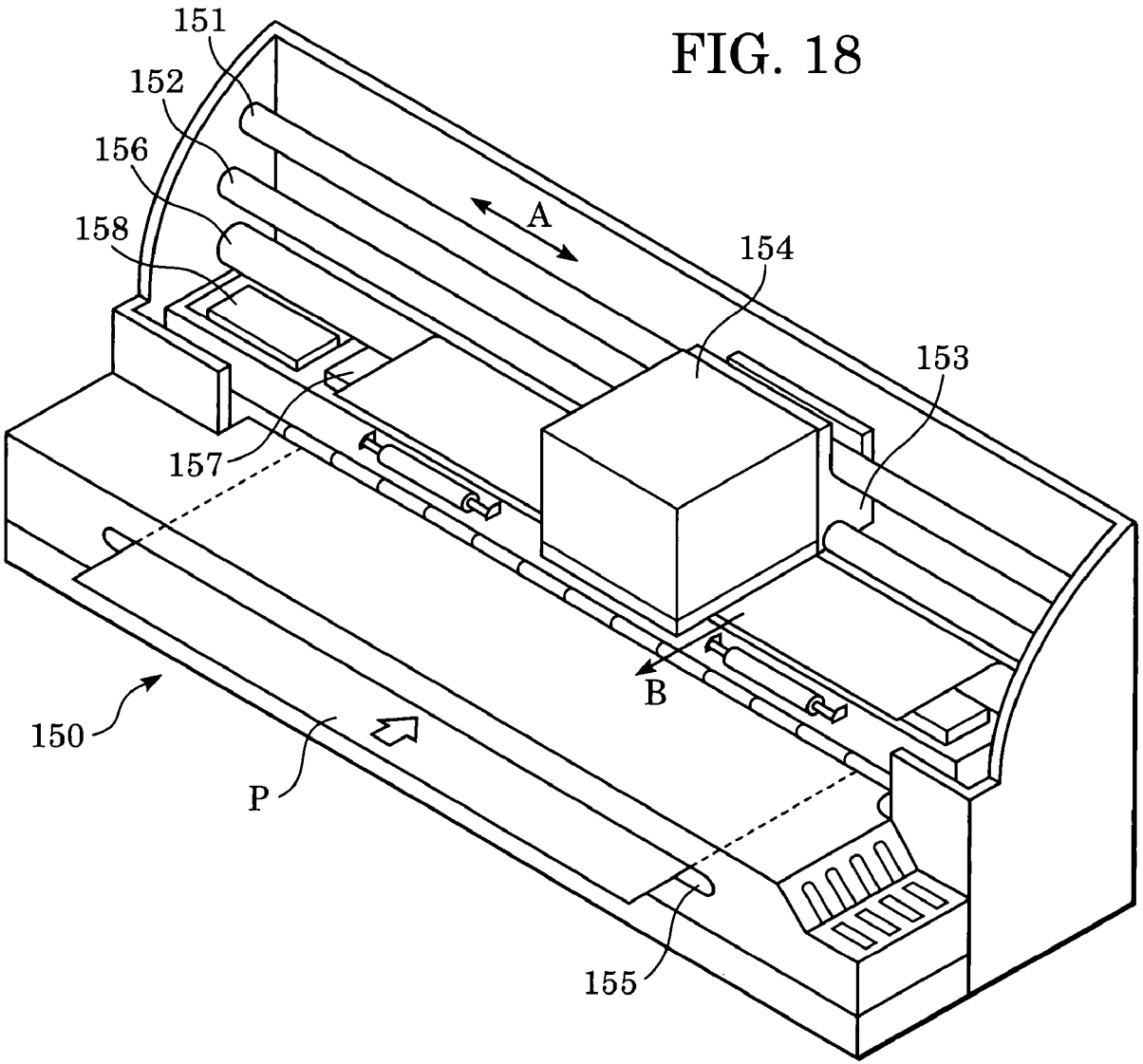
FIG. 18 is a perspective view of an inkjet recording apparatus to which the present invention is applicable.

FIG. 18 shows an example of an inkjet recording apparatus to which the present invention is applicable.

A recording apparatus 150 is a serial scanning inkjet recording apparatus. A carriage 153 is movably guided in the directions of double-headed arrow A (main scanning directions) by guide shafts 151 and 152. The carriage 153 reciprocates in the main scanning directions by a carriage motor and a driving force transfer mechanism, such as a belt, for transferring the driving force of the carriage motor. The carriage 153 carries an ink supplying system 154 comprising a recording head, an ink supplying unit, and an ink tank mounted to the ink supplying unit and used to supply ink. Any one of the above-described ink supplying systems may be used for the ink supplying system 154. After inserting a sheet P (recording medium) into a slot 155 in the front end of the recording apparatus 150, the direction of transportation of the sheet P is reversed in order to transport the sheet P in the direction of arrow B (sub-scanning direction) by a feed roller 156. The recording apparatus 150 successively records an image on the sheet P by repeating the recording operation and the transporting operation while the recording head is moved in the main scanning directions. In the recording operation, ink is discharged towards a recording area on the sheet P on a platen 157. In the transporting operation, the sheet P is transported in the sub-scanning direction by a distance corresponding to a recording width.

As mentioned above, the recording head may make use of thermal energy generated from an electrothermal conversion element as energy for discharging the ink. In this case, it is possible to discharge the ink from ink discharge openings by foaming energy generated by film boiling in the ink by heat generated by the electrothermal conversion member. It is also possible to discharge ink by using, for example, a piezo element.

A recovery system unit (recovering means) 158 opposing an ink discharge opening side of the recording head carried by the carriage 153 is disposed on the left end of the area of movement of the carriage 153 in FIG. 18. The recovery system unit 158 has, for example, a cap and a suction pump. The cap can cap the ink discharge openings of the recording head. The suction pump can provide negative pressure in the cap. By sucking and discharging ink from the ink discharge openings as a result of providing negative pressure in the cap which caps the ink discharge openings, it is possible to carry out a recovery operation for maintaining a good ink discharging state of the recording head. By discharging ink from the ink discharge openings towards the inside of the cap other than for the purpose of forming an image, it is possible to carry out a recovery operation (also called a preliminary discharge operation) for maintaining a good ink discharging state of the recording head. These operations can be carried out for satisfying Expression (4) or Expression (7) when a new ink tank is mounted.

(Other)

Although the embodiments in which storage means are disposed at the ink tank 10 and the ink supplying unit 50 and in which the amount of consumed ink is converted from the number of discharged ink drops, the embodiment in which the residual ink amount is detected by a prism, and the embodiment in which the residual ink amount is detected by electrodes are described, the present invention can provide the same advantages by a suitable combination of any of these embodiments.

In each of the above-described embodiments, the ink is basically held and supplied without holding the ink by, for example, an absorbing member, the negative pressure generating means is formed by the movable members (sheet 11 and pressure plate 14) and the spring 40 for biasing the movable members, and the ink supplying system has a sealed structure. Therefore, a proper negative pressure acts upon the recording head 20. Compared to a structure in which negative pressure is generated by an ink absorbing member, the above-described structure provides a high ink volume efficiency and allows the user to select from a larger number of types of ink because he/she does not need to consider whether the ink and the absorbing member match. In addition, it is possible to meet the demands of stabilizing ink supply and of increasing the amount of ink supply that are made due to an increase in the recording speed in recent years.

The present invention particularly focuses attention on the removal of gas held in the ink supplying path that is sealed. The gas is removed by being sent to the ink tank at the uppermost stream position that is most distant from the recording head. Therefore, by connecting the ink tank and the ink supplying path by a plurality of paths and making use of the balance between the pressure at the ink tank and the ink supplying path, the ink is sent out from the ink tank and the gas is sent into the ink tank concurrently. Such a structure is simple and has few parts, does not require a complicated device, and can smoothly and quickly remove the gas held in the ink supplying path to the ink tank. Since the gas is automatically removed in accordance with pressure balance when a predetermined amount of gas is held in the ink supplying path, the gas is removed with high reliability. In addition, since the negative pressure in the ink tank is always maintained when removing the gas, it is possible to reliably prevent ink leakage from, for example, an ink discharge opening of the inkjet recording head. Further, since the gas is removed to the ink tank, compared to the method of removing the gas from a discharge opening by sucking the ink from the discharge opening of the recording head, the amount of consumed ink can be considerably reduced, so that running costs can be reduced by reducing the amount of ink that is wasted.

Hitherto, when an ink tank which is removable from an ink supplying path is used, in order to prevent entry of gas into the ink supplying path when the ink tank is replaced, the ink tank is often replaced when the ink supplying unit contains ink, that is, before all of the ink in the ink supplying path is used up. However, according to the structure of the present invention, even if gas enters the ink supplying path when the ink tank is replaced, it is possible to easily remove gas to a new ink tank that is mounted. Therefore, the ink tank can be replaced after the ink is used up. This not only further reduces running costs, but also is a large factor in overcoming environmental problems. In each of the embodiments, the ink tank in its ordinary posture is disposed at the highest location, and a liquid chamber or the recording head is disposed at lower locations. This is very desirable for carrying out quick and smooth gas-liquid exchange by a simple structure.

The gas may be held in any location in the ink tank as long as the gas sent into the ink tank does not return to the ink supply path and hinder the ink supply. However, when, as in the aforementioned embodiments, the ink is held in the ink tank without absorbing the ink by using, for example, an absorbing member, the gas sent into the ink tank is at the uppermost portion of the ink tank. Therefore, it is desirable for the gas to be held at the uppermost portion of the ink tank. Accordingly, when an ink-absorbing member does not exist in the ink tank, the volume of the ink tank itself may correspond to the amount of ink contained in the ink tank. Therefore, it is not necessary to increase the size of the ink tank more than is necessary, and the form of the ink tank can be designed relatively freely.

Although the present invention is applied to a serial inkjet recording apparatus in the embodiments, the present invention may be applied to various other recording apparatuses. For example, the present invention may be applied to a line-scanning recording apparatus. Obviously, a plurality of the ink supplying systems may be disposed in correspondence with the tones (colors, concentrations, etc.) of the ink.

The present invention may be broadly applied to a system for supplying a liquid other than ink, such as chemicals or beverages.

While the present invention has been described with reference to what are presently considered to be the embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An ink supplying system, comprising:

a replaceable ink tank configured to contain ink and perform recording; and an ink supplying unit, connected to the ink tank through a plurality of communication paths, facilitating supplying ink introduced from the ink tank to a recording head, the ink supplying unit having a substantially sealed space other than at a portion of connection of the recording head and the plurality of communication paths, wherein the ink in the ink tank is introduced into the ink supplying unit through at least one of the communication paths, and gas in the ink supplying unit is transported into the ink tank through at least a different one of the communication paths, wherein the ink tank includes a first storage unit configured to store information regarding a residual amount in the ink tank, the ink supplying unit including a second storage unit configured to store information regarding a residual ink amount in the ink supplying unit, and wherein an ink amount to be used for recording can be calculated based on the information regarding the residual ink amount stored in the first and the second storage units.

2. The ink supplying system according to claim 1, wherein the first and second storage units include EEPROM.

3. The ink supplying system according to claim 1, wherein the first and second storage units include FeRAM.

4. The ink supplying system according to claim 1, further comprising detecting means for detecting at least one of the residual ink amount in the ink tank and the residual ink amount in the ink supplying unit.

5. The ink supplying system according to claim 4, wherein the detecting means detects the position of the surface of the ink in the ink tank or the ink supplying unit.

6. The ink supplying system according to claim 5, wherein the detecting means includes a prism to optically detect at least one of the ink level in the ink tank and the ink level in the ink supplying unit.

7. The ink supplying system according to claim 5, wherein the detecting means includes a pair of electrodes to electrically detect at least one of the ink level in the ink tank and the ink level in the ink supplying unit.

8. The ink supplying system according to claim 1, wherein an ink amount (At+Bt) calculated as a usable ink amount (Qt) can be stored in the first and second storage units based on an ink amount (At) in the ink tank stored by the first storage unit and an ink amount (Bt) in the ink supplying unit stored by the second storage unit.

9. The ink supplying system according to claim 1, wherein the first and the second storage units are capable of updating the information regarding the residual ink amount.

10. The ink supplying system according to claim 1, further comprising a calculating unit configured to calculate an amount of consumed ink in the recording head, wherein information regarding a residual ink amount to be used for recording can be updated based on the amount of consumed ink calculated by the calculating unit.

* * * * *